US005398354A

United States Patent [19]

Balonick et al.

[11] Patent Number: 5,398,354

[45] Date of Patent: Mar. 21, 1995

[54] HEEL PILLOW MATTRESS

[75] Inventors: Arnold Balonick, Encino; Larry Lankard, Fallbrook; Curtis Wyatt, San Juan Capistrano, all of Calif.

[73] Assignee: B. G. Industries, Inc., Northridge, Calif.

[21] Appl. No.: 88,135

[22] Filed: Jul. 7, 1993

[51] Int. Cl.[6] ..... A47C 27/15; A61G 7/057

[52] U.S. Cl. ..... 5/464; 5/470; 5/481; 5/922

[58] Field of Search ..... 5/464, 462, 470, 471, 5/481, 922, 645, 648, 473

[56] References Cited

U.S. PATENT DOCUMENTS

| | | | |
|---|---|---|---|
| D. 282,037 | 1/1986 | Lawson et al. | D6/606 |
| D. 311,295 | 10/1990 | Roberts | D6/595 |
| 965,637 | 7/1910 | Klimowicz et al. . | |
| 2,207,095 | 9/1940 | Hutchinson . | |
| 2,462,579 | 2/1949 | Warner | 5/462 |
| 2,810,920 | 10/1957 | Carruth | 5/462 |
| 3,419,920 | 1/1969 | Maddux, Jr. et al. | 5/465 |
| 4,536,906 | 8/1985 | Varndell et al. | 5/468 |
| 4,628,557 | 12/1986 | Murphy | 5/464 |
| 4,843,666 | 7/1989 | Elesh et al. | 5/447 |
| 5,107,558 | 4/1992 | Lück | 5/464 |
| 5,136,741 | 8/1992 | Balonick et al. | 5/481 |

FOREIGN PATENT DOCUMENTS

| | | | |
|---|---|---|---|
| 23075 | 6/1936 | Australia | 5/645 |
| 1518845 | 7/1978 | United Kingdom . | |
| 8102384 | 9/1981 | WIPO | 5/464 |

*Primary Examiner*—Alexander Grosz
*Attorney, Agent, or Firm*—Lewis Anten; Amedeo Ferraro

[57] ABSTRACT

A mattress to prevent the creation of pressure sores having a heel pillow portion intended for use in health-care facilities having replaceable parts is disclosed. The heel pillow mattress of the present invention is made of foam and has a cavity located at the foot area of the mattress for containing a pillow therein. A soft, resilient pillow insert contained within the cavity provides cushion for the heels of a patient lying on the mattress. A layer of foam covers the top of the cavity containing the pillow insert. This layer of foam has a low indentation force deflection (IFD) to provide a high degree of cushioning for the heels. This layer of foam together with the pillow insert beneath it, provide increased cushioning when a patient's heels apply a downward force on the mattress so that as the heels sink into the mattress, the foam layer and the pillow insert give way to the downward force of the heels and the mattress cradles the heels. The degree to which the heels sink into the mattress is proportional to the load applied. The increased cushion and cradling effect of the heel pillow mattress of the present invention effectively prevents and avoids the creation of pressure sores. The heel pillow mattress is covered by a water and moisture impervious cover.

41 Claims, 3 Drawing Sheets

FIG. 4
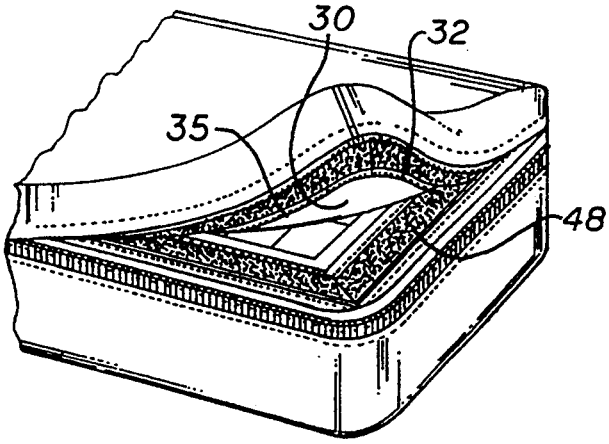
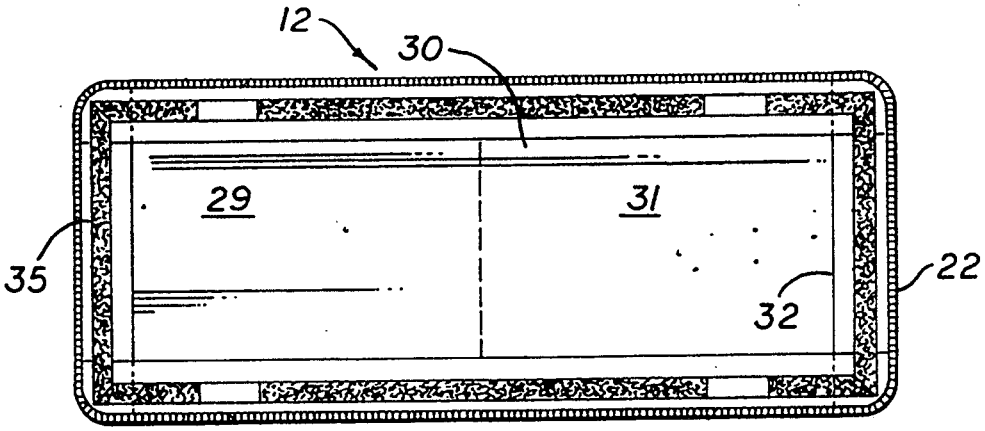
FIG. 5
FIG. 6
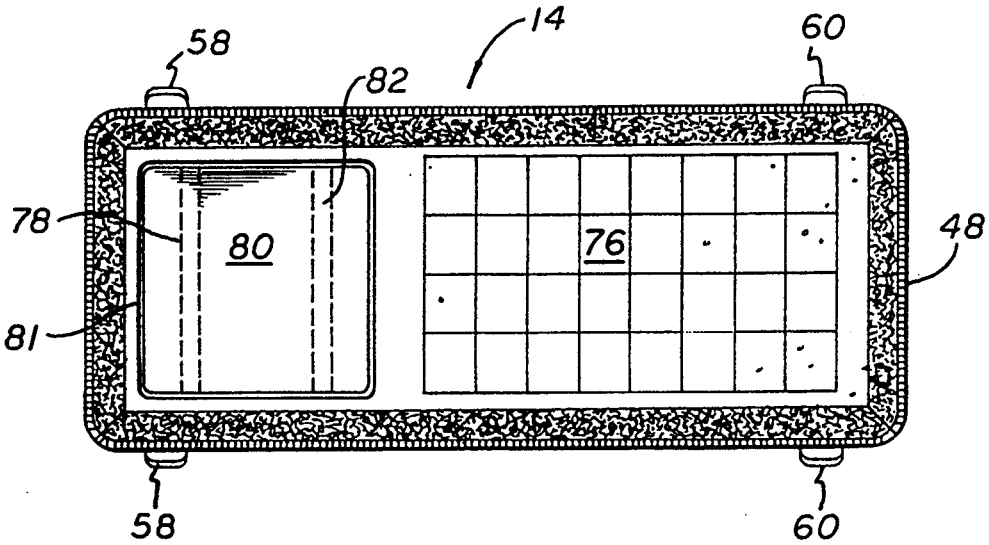

HEEL PILLOW MATTRESS

BACKGROUND OF THE INVENTION

1. Field of the Invention

The present invention relates to health care intensive care/specialty mattresses, and in particular to such mattresses having a removable heel pillow for use in the prevention and treatment of pressure sores and other tissue damage aggravated by pressure or resulting from abrasion and/or shearing.

2. Description of the Related Art

It is well known that bedridden patients are often subject to pressure sores due to the patient's weight causing the skin to be pressed between the patient's bone structure and the underlying surface. For example when an individual lies in a given position for an extended period of time, protrusions in the skeletal structure, such as the heels, cause the soft tissue covering the heel bone to be squeezed against the underlying supporting mattress. As soft tissue is squeezed, the blood flow in the area is altered, making that tissue especially susceptible to pressure sores. Pressure sores are particularly prevalent in the vicinity of bony protrusions, and can occur within as short a period of time as 2–4 hours.

Pressure sores are caused by the reduction or lack of blood flow to skin and muscle tissue. The deprived cells quickly die and sores form. These sores often become open wounds which can spread throughout the body's soft tissue and finally expose the bone mass itself. Predisposing conditions which contribute to the formation of pressure sores include circulatory disease and the exposure of tissue to extreme temperatures, as well as shearing, i.e. internal friction, which can stretch and close capillary vessels. The major cause of pressure sores, however is pressure.

In the past a variety of mattresses have been devised to eliminate or reduce pressure creating surfaces of mattresses. In particular, consideration has been given to providing mattresses with cut-out sections such as in U.S. Pat. No. 2,810,920 issued to Carruth on Oct. 29, 1957; U.S. Pat. No. 4,536,906 issued to Varndell et al. on Aug. 27, 1985; U.S. Pat. No. 4,628,557 issued to Murphy on Dec. 16, 1986; U.S. Pat. No. 4,706,313 issued to Murphy on Nov. 17, 1987; and U.K. Patent No. 1,518,845 issued to Hargest on Jul. 26, 1978. In addition, a foam mattress having two layers and a removable antimicrobial, moisture impervious outer cover is disclosed in U.S. Pat. No. 5,136,741, issued to Balonick et al. on Aug. 11, 1992.

The Carruth patent discloses a mattress with a removable plug in a recessed section of the mattress. The plug is used to fill the recess and is made from the same material as the mattress body in order to provide continuity with the mattress body when the plug is in place. The recessed section allows a person's face to be inserted in the recessed section when the person is lying face down on the mattress.

The Varndell et al. patent discloses a mattress having a removable head supporting perforated insert. The insert is made of foam and has the same thickness as the rest of the mattress body. The insert serves to reduce the risk of suffocation when a patient is lying face down on the mattress.

The Murphy ('557) patent discloses a mattress with removable foam inserts and having a cut-out portion in the mattress that goes all the way through the mattress, with the cover of the mattress forming the bottom of the cut-out.

The Murphy ('313) patent discloses a mattress having a plurality of recesses in the top surface of the mattress with a plurality of foam inserts to be placed in the recesses. There must be at least one opening in the mattress and the cover over the opening is required to have a specific configuration.

The British patent issued to Hargest discloses a single layer mattress with a cavity, into which removable inserts of variable densities differing from the density of the material used in the rest of the mattress are placed. The inserts are made of a foam product that is cut so that a plurality of two-inch squares of foam product, with one-inch space in between, lies on one side of the insert.

While the mattresses of the past have been relatively successful in reducing the pressure creating surfaces of a mattress, they have also encountered several disadvantages and difficulties. For example, these mattresses required a patient's heels or other areas of bony protrusion to be positioned directly over only one relatively small spot in the mattress where the insert was located. Also, since mattresses of the past utilized inserts of varying density the mattresses had to be reconfigured with the insert having the appropriate density to provide the necessary pressure relief to the patient. The reconfiguration of the mattress necessitated the opening of the protective outer cover of the mattress increasing the possibility of contamination of the mattress. The reconfiguration of the mattresses also involves moving the patient from the bed. Moreover, since different foam inserts were required, the inserts had to be stored when not in use.

OBJECTS OF THE INVENTION

It is the object of the present invention to provide a heel pillow mattress which can replace the pressure creating surfaces in juxtaposition to pressure sensitive heels.

It is another object of the present invention to provide a heel pillow mattress where there is no need to remove and store internal foam components.

It is a further object of the present invention to provide a heel pillow mattress where there is no need to position patients' heels over only one small spot.

It is yet a further object of the present invention to provide a heel pillow mattress where there is no need to move the patient or open the mattress, reducing the possibility of contamination.

These and other objects of the present invention will be apparent from a review of the following specification and the accompanying drawings.

SUMMARY OF THE INVENTION

The present invention provides a mattress with a heel pillow insert which is flexible, provides increased cushioning and a greater contact surface area for an even distribution of pressure at the sensitive pressure points of the heels. The heel pillow mattress of the present invention is made of foam and has a cavity located at the lower leg area of the mattress for containing a pillow. A soft, resilient pillow insert contained within the cavity provides cushion for the heels of a patient lying on the mattress. The pillow insert has a top cover, a soft top layer, a firmer bottom layer, and a bottom cover. A layer of foam covers the top of the cavity containing the pillow insert. This layer of foam has a low indentation force deflection (IFD) to provide a high degree of cushioning for the heels. This layer of foam and the pillow insert beneath it, provide increased cushioning when a patient's heels are placed on the foam layer and apply a downward force on the mattress so that as the heels sink into the mattress, the softer layers give way to the downward force of the heels and the mattress cradles the heels. The degree to which the heels sink into the mattress is proportional to the load applied, so that the heels of a patient reach the lower, firmer layers of the pillow insert only when the load applied is great. The firmer layers also provide support for the softer layers and prevent the heels from bottoming out when the load applied to the mattress is too great. The increased cushion and cradling effect of the heel pillow mattress of the present invention effectively helps to prevent and avoid the creation of pressure sores.

In the preferred embodiment, the heel pillow mattress of the present invention has replaceable, interchangeable parts. The pillow insert is made of a polyester fiber material having a cover and an inner filling having two layers, a softer top layer and a firmer bottom layer. However, the pillow insert may also be a foam piece having a low density and low IFD that fits within the cavity. The heel pillow mattress is covered by a water and moisture impervious cover. The cover is formed in two halves, with the two halves of the cover being Joined together by a zipper around the side walls of the mattress to entirely enclose the heel pillow mattress.

The construction of the heel pillow mattress of the present invention is simple and inexpensive to manufacture. The component parts may be replaced if damaged. Further, the heel pillow mattress as a unit, as well as the upper and lower layers, may be easily shipped.

BRIEF DESCRIPTION OF THE DRAWINGS

FIG. 4 is a partial right top perspective view of a corner of the heel pillow mattress of the present invention.

FIG. 5 is a plane view of the bottom of the top half of the heel pillow mattress of the present invention.

FIG. 6 is a plane view of the top of the bottom half of the heel pillow mattress of the present invention.

DETAILED DESCRIPTION OF THE DRAWINGS

Figure 1:
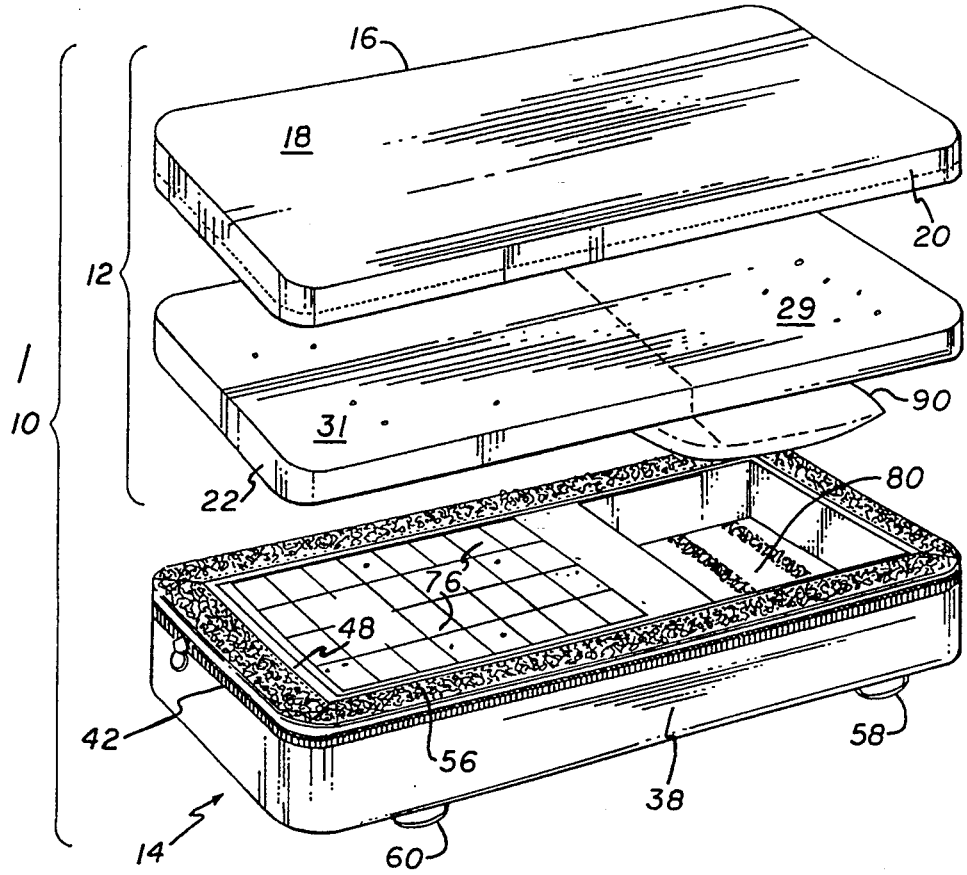
FIG. 1 is an exploded view of the heel pillow mattress of the present invention.
Figure 2:
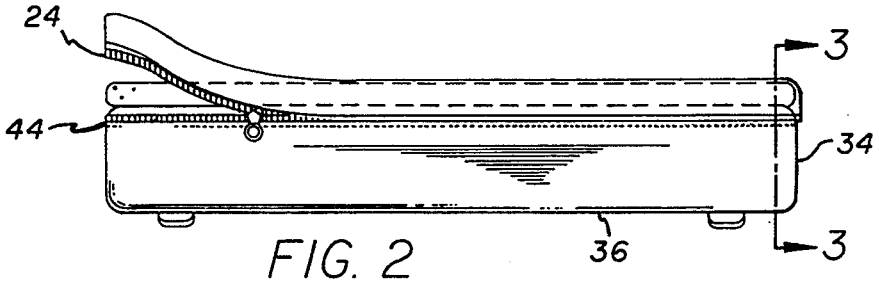
FIG. 2 is a side view of the present invention, with a portion of the heel pillow mattress cover unzipped.
Figure 3:
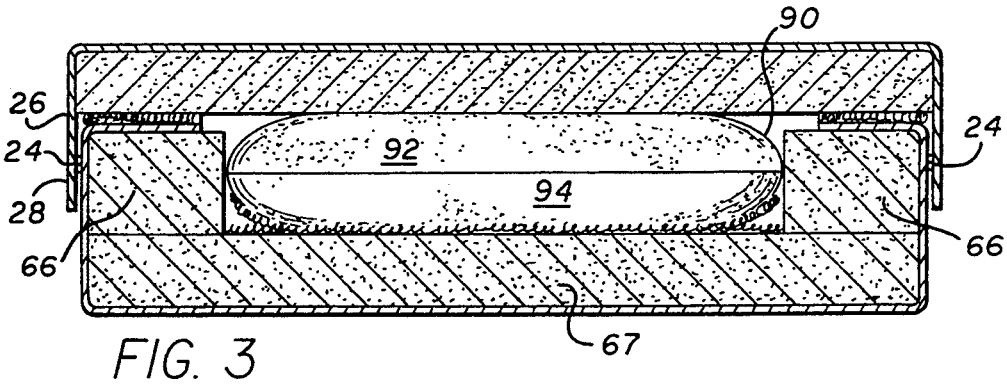
FIG. 3 is a side sectional view taken along lines 3—3 of FIG. 2.

Referring to the FIGS. 1-3, the heel pillow mattress 10 of the present invention is shown formed in an upper half 12 and a lower half 14. The upper half 12 consists of a loose upper cover 16 having a top surface 18 and depending sides 20 enclosing three sides of upper layer 22 comprising a foam material having a rectangular solid shape. One half of a zipper 24 is attached to the inside flat surface 26 of the depending sides 20 of cover 16 so that a portion 28 of the depending sides 20 of cover 16 extends beyond the zipper portion 24. The zipper portion 24 extends substantially around the periphery of the depending sides 20.

As shown in FIGS. 4 and 5, the bottom surface 30 of the upper foam layer 22 has an attached fabric layer 32 around its periphery. In the preferred embodiment this fabric layer 32 is attached to the upper foam layer 22 by adhesive or other suitable means, such as by sewing.

Attached to the fabric layer 32 is one half of a hook and loop removable connector means 35, such as the connector means that is sold under the trademark Velcro. The removable connector means 35 surrounds substantially the entire periphery of the upper foam layer 22. The fabric layer 32 is about two and seven-eights inches wide and the removable connector means 35 is approximately one and one-half inches wide.

In the preferred embodiment the upper foam layer 22 is approximately one and one-half inches thick, with the length and width varying according to size of the mattress. For example, the more commonly used mattresses have lengths and widths of 35×80, 32×79 and 35×84 inches.

The upper layer 22 is made from two pieces of foam of different IFD's. The first piece 29 of the upper layer is a foam material made from polyurethane foam of approximately one point eight (1.8) lbs. density or higher, open cell construction, having a flame retardant nature. The second piece 31 of the upper layer 22 is made from polyurethane foam, of approximately 2.4 lbs. density, open cell construction, having an anti-microbial and flame retardant nature. The first piece 29 and the second piece 31 are adhered together at their ends so as to form the rectangular upper layer 22.

The upper cover 16 may be made of seventy (70) denier coated nylon and is larger in width and length so as to permit a loose billowy fit of the top 18 over the upper foam layer 22. The cover 16 may be anti-bacterial, flame retardant, or moisture resistant. The upper foam layer 22 is of such a size so that it fits snugly within the depending sides 20 of the cover 16.

The depending sides 20 of the upper cover 16 are a continuation of the upper cover 16 and extend about three and one-fourth inches from the top surface 18 and about one-half inches beyond the zipper portion 24.

The lower half 14 of the heel pillow mattress 10 consists of a bottom cover 34 having a bottom surface 36 and upraised sides 38 enclosing the sides of a first lower foam layer 66 having a rectangular solid shape. The first lower foam layer 66 and a second lower foam layer 67, when placed on top of each other, are thicker than the upper foam layer 22. The portion of a zipper 42, corresponding to the other half of zipper portion 24, is attached to the top portion 44 of the upraised side 38, around substantially the entire periphery of the upraised sides 38.

As shown in FIGS. 1, 4, and 6 the bottom cover 34 has an extension member 48 extending around the top of the upraised sides 38 in a plane substantially parallel to the bottom surface 36. The extension member 48 has an overlaying hook and fabric removable connector 56 corresponding to the other portion of the hook and fabric removable connector 35 attached to the upper foam layer 22 of the upper half 12. The hook and fabric removable connector 56 may be attached by adhesive, sewing or any other known adhering means. The bottom surface 36 is sewn to the upraising sides 38 of the bottom cover 34. Cloth handles 58 and 60 are sewn into the seams connecting the bottom surface 36 and upraised sides 38 of the bottom cover 34, to facilitate the handling of the heel pillow mattress 10.

In the preferred embodiment the first lower foam layer 66 is approximately two inches thick and varies in width and length according to the mattress size. The second lower foam layer 67 is approximately two and three-fourths inches thick. The foam material used in layers 66 and 67 is made from polyurethane foam of approximately one point eight (1.8) density or higher, open cell construction, having an anti-microbial nature and flame retardant nature. The bottom cover 34 is made of a laminated vinyl synthetic fabric and is slightly larger than the lower foam portion in width and length so as to permit a relatively snug fit over the lower foam layers 66 and 67, thus retaining the lower foam layers 66 and 67 within the enclosed space. The bottom cover may have thirteen point four (13.4) ounces weight or less, antibacterial properties, flame retardant properties, and may be moisture and stain resistant. An approximate one inch, or less, surplus of width and length for the cover is usually sufficient to permit a relatively snug fit. The lower foam layers 66 and 67 are pliable so that they can be compressed and deformed so that they may be placed within the enclosed space formed by the bottom cover 34.

In the preferred embodiment, as shown in FIG. 6, the first lower foam layer 66 has a plurality of body pressure relief cuts 76 and a rectangular cut-out approximately 25 inches long and 18 inches wide, located at one end of the first lower layer 66. The second lower layer 67 is thicker than the first lower layer 66 but has the same width and length and is made from the same foam material. The first lower layer 66 is attached to the second lower layer 67 by adhesive or other suitable means so that the second lower layer forms the bottom 80 of the rectangular cut-out of the first lower layer so that an open rectangular recess 78 having a bottom 80 and sides 81 is formed. The hook side of a hook and loop fastener 82 is attached to bottom 80 within the rectangular recess. A pillow insert 90 approximately 18 inches wide and 25 inches long and shaped to fit into the rectangular recess 78 is placed within the rectangular recess 78 and secured to the second lower layer 67 by way of the hook and loop fastener 82.

The extension member 48 of the bottom cover 34 is about 3 inches wide and the removable connector means 56 is approximately 1 and ½ inches wide. The lower foam layers 66 and 67 are enclosed within the partially enclosed space formed by the bottom surface 36, the upraised sides 38 and the extension member 48 of the bottom cover 34.

Figure 7:
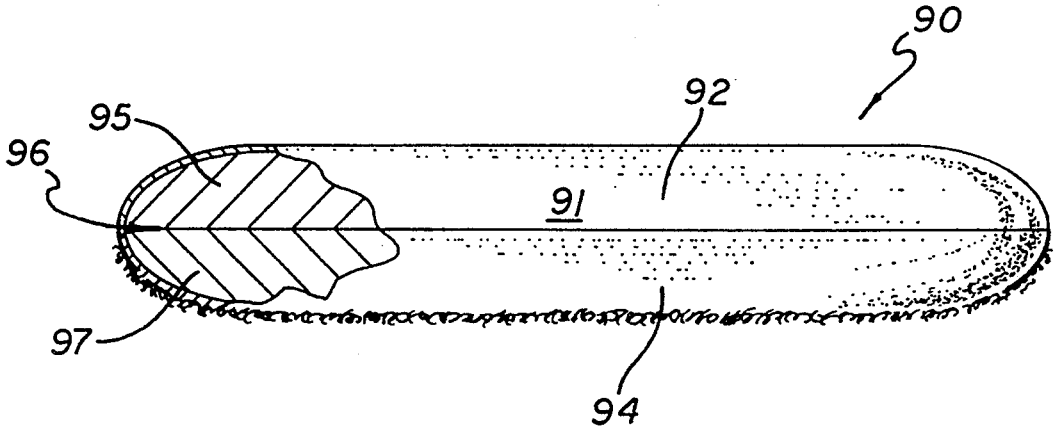
FIG. 7 is a side view of the pillow insert of the heel pillow mattress of the present invention with a partial cut-away of the top fabric.

Referring to FIG. 7, the pillow insert 90 consists of a top fabric 92, a backing 94 and a filler 96. The top fabric 92 is approximately the top half of the cover 91 of the pillow insert 90 and is a thin, non-woven polyester material. Filler 96 is composed of two layers, a softer top filler layer 95 and a firmer lower filler layer 97. Top filler layer 95 is one and a half ounces per square foot, siliconized, hollow polyester fiber that has been needle-punched and thermobonded. In order to thermobond siliconized fiber, it is necessary to incorporate 10–15% "low melt" to the polyester material. This mix is then baked in an oven. The lower filler layer 97 is also a thermobonded needle-punched polyester fiber material, but has a weight of one and three quarter ounces per square foot so that it is heavier and firmer than the upper filler layer 95 in order to provide progressively more support for the heel as it sinks into pillow insert 90 through upper filler layer 95 to reach the lower filler layer 97. The backing 94, approximately the bottom half of the cover 91 of the pillow insert 90 is a needle punched polyester fiber which is highly densified and has an outer surface textured so that it will adhere to the hook side of a hook and loop fastener in order to secure the pillow insert 90 in place. Thus, pillow insert 90 is nonreversible in order to maintain progressively increasing support for the heel and due to the texture of the outside surface of the backing 94 for adhering to a hook and loop fastener.

Referring to FIGS. 1 through 4, the heel pillow mattress 10 is assembled by first placing the upper foam layer 22 within the upper cover 16 with the surface of the upper foam layer 22 having the removable connecting means 35 facing away from the top surface 18 of the upper cover 16. The first lower foam layer 66 is then placed over and adhered to the second lower foam layer 67. Both layers 66 and 67 are then placed within the enclosed space formed in the bottom cover 34 with the surface of the first lower foam layer 66 having body pressure relief cuts 76 and the opening of the rectangular recess 78 facing away from the bottom surface 36 of the bottom cover 34.

Pillow insert 90 is then placed within the rectangular recess 78 with the backing 94 facing the bottom 80 of the recess 78 and secured in place by hook and loop fastener 82.

The upper half 12 and the lower half 14 of the heel pillow mattress 10 are then placed on top of one another so that the removable connecting means 35 and 56 come into contact with one another, holding the two halves 12 and 14 together. The corresponding zipper portions 24 and 42 are then attached, zipping the two halves together.

As shown in FIG. 3, the upper half of the zipper 24 is set on the inside of the depending sides 20 of the upper cover 16 away from the end of the depending side 20, and the lower foam layer 66 is enclosed within the bottom cover 34 so that the space between the teeth of the zipper is covered. Also, any fluid or other material that may pass through the space in the zipper is prevented from coming into contact with either the upper foam layer 22 or the lower foam layers 66 and 67, since the layers are protected by the sides 20 and 38 of the upper cover 16 and the lower cover 34.

The above construction permits the upper cover 16, the lower cover 34, the upper foam layer 22, the lower foam layers 66 and 67 and pillow 90 to all be separately replaced should any of these parts be damaged. Also, the construction provides for a simple means of maintaining the two halves of the heel pillow mattress in a fixed relationship to one another in an inexpensive and simple way. In addition, the top cover 16 can easily be fixed to the upper foam layer 22 permitting a loose billowing effect to be achieved by the top cover. The simple configuration permits the separation of the top half 12 from this bottom half 14 so that the two halves 12 and 14 can then be shipped and stored separately if so desired.

Some of the advantages of the present invention, particularly insofar as a reduction in pressure between the mattress and the patient's body is concerned are shown in the following test results. A mattress constructed in accordance with the present invention was placed within an ordinary hospital bed frame and a sheet was placed over the mattress. All interface pressure measurements were made using the Texas Interface Pressure Evaluator (TIPE) or Mini-TIPE. The subjects used in the testing were categorized by body build using the norms published in *Doucumenta Geigy Scientific Tables,* 6th edition, 1962, "Average Weight for Adults". Table 1 shows the body build and gender of the subjects.

TABLE 1

| SUMMARY OF THE SUBJECT BODY BUILD* | |
|---|---|
| THIN BUILD | |
| MALE | 3 |
| FEMALE | 1 |
| TOTAL | 4 |
| AVERAGE BUILD | |
| MALE | 2 |
| FEMALE | 2 |
| TOTAL | 4 |
| LARGE BUILD | |
| MALE | 2 |
| FEMALE | 2 |
| TOTAL | 4 |
| TOTAL OF SAMPLE | 12 |

*DEFINED AS:
THIN
Less than 85% of the ideal body weight normal for age, sex, and frame size.
AVERAGE
Between 85% and 115% of the ideal body weight normal for age, sex, and frame size.
LARGE
Greater than 115% of the ideal body weight normal for age, sex, and frame size.

The test results are summarized in Table 2. This table shows the average peak pressure under each of the bony areas and the standard deviation associated with the readings for a standard hospital mattress and the heel pillow mattress of the present invention.

TABLE 2

SUMMARY OF PEAK PRESSURE DATA

| BODY BUILD | BONY PROMINENCE | STD. MATTRESS | HEEL PILLOW MATTRESS |
|---|---|---|---|
| THIN | SCAPULAR AREA | 27 +/− 13 | 18 +/− 6 |
| | SACRAL AREA | 33 +/− 14 | 18 +/− 5 |
| | TROCHANTERIC AREA | 78 +/− 25 | 36 +/− 5 |
| | HEELS | 59 +/− 16 | 34 +/− 11 |
| AVERAGE | SCAPULAR AREA | 29 +/− 12 | 21 +/− 3 |
| | SACRAL AREA | 34 +/− 7 | 20 +/− 6 |
| | TROCHANTERIC AREA | 76 +/− 18 | 41 +/− 8 |
| | HEELS | 67 +/− 11 | 36 +/− 9 |
| LARGE | SCAPULAR AREA | 34 +/− 5 | 17 +/− 4 |
| | SACRAL AREA | 41 +/− 6 | 20 +/− 4 |
| | TROCHANTERIC AREA | 82 +/− 16 | 38 +/− 6 |
| | HEELS | 70 +/− 19 | 27 +/− 5 |

All pressures are recorded in mmHg, and the tabulated values are the AVERAGE PEAK PRESSURE +/− SD.

The results show very low pressure readings for virtually every position in which the subjects were oriented on the mattress. Such low pressure readings would, it is believed, substantially contribute to a patient's comfort and to the avoidance of pressure sores to a bedridden patient.

While the present invention has been described with regards to the preferred embodiment, it is understood that variations to the present invention may be made without departing from the concept of the present invention.

For example, while in the preferred embodiment of the present invention the upper foam layer 22 is removably attached to the first lower foam layer 66 by the removable connecting means 35 and 56, it is possible to permanently fix upper foam layer 22 to first lower foam layer 66 by a number of known adhering means such glue.

In another embodiment of the present invention, instead of having body pressure relief cuts 76 in the first lower foam layer 66, layer 66 may have a section comprising of soft convoluted foam, such as the foam sold under the trademark "Egg-Crate", in order to provide body pressure relief to the patient.

In yet another embodiment of the present invention, instead of having pillow insert 90 in the recess 78, a heel block made from a soft foam material may be placed within the recess 78.

Other variations with respect to the outer cover portions 16 and 34 of the preferred embodiment of the present invention are also within the scope of the present invention. For example, while in the preferred embodiment the bottom cover 34 has the removable connector means 56 attached to the extension member 48, it is possible to have the removable connector means 56 attached directly to the first lower foam layer 66 so that the removable connector 56 attaches directly to the corresponding connector means 35 on the upper foam layer 22. The lower foam layers 66 and 67 can be attached to the bottom cover 34 by any suitable means, including the use of the extension member 48 to prevent movement of the lower foam layers 66 and 67 in relationship to the bottom cover 34.

Also, while in the preferred embodiment the lower foam layers 66 and 67 are partially enclosed by the bottom cover 34, the upper foam layer 22 could be partially enclosed or both the upper and lower foam layers 22, 66 and 67, respectively, could be partially enclosed with the removable connectors 35 and 56 being fixed on both the upper cover 16 and bottom cover 34 to maintain the upper foam layer 22 and the lower foam layers 66 and 67 fixed to one another.

Also, in place of a zipper 24/42 for connecting the upper cover 16 and bottom cover 34, other removable connector means may be used, such as hook and loop connectors. Also, a hook and loop connector means can be used to hold the depending sides 20 attached to the bottom cover 34 to further prevent any fluids or contaminants from entering through the space between the teeth of the zipper 24/42.

What is claimed is:

1. A heel pillow mattress comprising:

a first layer of a compressible material;

a second layer of a compressible material, said second layer including a recess proximate one end;

an insert made of a compressible material inserted within said recess, said compressible material comprising a plurality of filler layers including a first top filler layer and a second bottom filler layer, said second bottom filler layer having a higher density and indentation force deflection than said first top filler layer; and a cover material covering said recess whereby when a user is lying on said heel pillow mattress, the user's heels are positioned over said recess and are supported by said compressible material inserted within said recess.

2. The heel pillow mattress of claim 1 in which said insert is a pillow.

3. The heel pillow mattress of claim 2 in which said pillow comprises a top fabric and a backing, said top fabric fixed to said backing forming a pocket therebetween to contain said plurality of filler layers.

4. The heel pillow mattress of claim 3 in which said top fabric comprises a thin, non-woven polyester material.

5. The heel pillow mattress of claim 3 in which said backing comprises a highly densified polyester fiber, said backing having an outer surface capable of adhering to one half of a hook and loop fastening means.

6. The heel pillow mattress of claim 3 in which at least one of said plurality of filler layers is a siliconized, thermobonded hollow polyester fiber.

7. The heel pillow mattress of claim 1 in which said insert comprises a foam material.

8. The heel pillow mattress of claim 7 in which said foam insert has a different density than said second layer of compressible material.

9. The heel pillow mattress of claim 1 in which said first layer has a first section having a different density and indentation force deflection than the rest of said first layer.

10. The heel pillow mattress of claim 9 in which said first section corresponds and is positioned directly above said recess.

11. The heel pillow mattress of claim 1 in which said compressible material is foam.

12. The heel pillow mattress of claim 11 in which said foam is polyurethane having an open cell construction, said polyurethane foam being anti-microbial and flame retardant.

13. The heel pillow mattress of claim 1 in which said second layer includes body pressure relief cuts.

14. The heel pillow mattress of claim 1 including means for removably attaching said first layer to said second layer.

15. The heel pillow mattress of claim 1 in which said first and second layers of compressible material are permanently fixed to each other.

16. The heel pillow mattress of claim 1 including an outer cover for containing therein said first and second layers.

17. The heel pillow mattress of claim 16 in which said outer cover comprises a corresponding first cover portion having a top and sides enclosing at least the top surface and sides of said first layer, and a corresponding second cover portion having a bottom and sides enclosing at least the bottom surface and the sides of said second layer.

18. The heel pillow mattress of claim 17 including zipper means for removably attaching said first cover portion to said second cover portion, said zipper means being covered on both its interior and exterior sides by at least one of said sides of said first and second covers.

19. The heel pillow mattress of claim 17 including means for removably fixing at least one of said layers in relationship to its corresponding cover.

20. A heel pillow mattress comprising:

a first foam layer having a top surface, a bottom surface and sides;

a second foam layer having a top surface, a bottom surface, and sides, said second foam layer having a cut-out therethrough proximate one end;

a third foam layer having a top surface, a bottom surface and sides, the bottom surface of said second foam layer being secured by adhesive means to the top surface of said third foam layer, said cut-out defining the opening of a recess in the top surface of said second layer, the top surface of said third foam layer defining the bottom surface of said recess; and an insert made of a compressible material inserted within said recess, said compressible material comprising a plurality of filler layers including a first top filler layer and a second bottom filler layer, said second bottom filler layer having a higher density and indentation force deflection than said first top filler layer, said first foam layer covering said recess whereby when a user is lying on said heel pillow mattress, the user's heels are positioned over said recess and are supported by said compressible material inserted within said recess.

21. The heel pillow mattress of claim 20 in which said second foam layer has the same or lower density and a higher indentation force deflection than said first foam layer.

22. The heel pillow mattress of claim 20 in which said third foam layer has the same density and same or higher indentation force deflection as said second foam layer.

23. The heel pillow mattress of claim 20 in which said first foam layer having at least a first section having a different density and indentation force deflection than the rest of said first foam layer.

24. The heel pillow of claim 23 in which said first section of said first foam layer is positioned directly above said recess.

25. The heel pillow mattress of claim 20 in which said insert is a pillow.

26. The heel pillow mattress of claim 25 in which said pillow comprises a top fabric and a backing, said top fabric fixed to said backing forming a pocket therebetween to contain said plurality of filler layers.

27. The heel pillow mattress of claim 26 in which said top fabric comprises a thin, non-woven polyester material.

28. The heel pillow mattress of claim 26 in which said backing comprises a highly densified polyester fiber, said backing having an outer surface capable of adhering to one half of a hook and loop fastening means.

29. The pillow of claim 26 in which at least one of said plurality of filler layers is a siliconized, thermobonded hollow polyester fiber.

30. The heel pillow mattress of claim 20 in which said first, second and third foam layers are polyurethane foam having an open cell construction, said polyurethane foam being anti-microbial and flame retardant.

31. The heel pillow mattress of claim 20 in which the top surface of said second foam layer includes body pressure relief cuts.

32. The heel pillow mattress of claim 20 including first means for removably fixing said first foam layer to said second foam layer.

33. The heel pillow mattress of claim 32 in which said first means for removably fixing includes a hook and loop fastener.

34. The heel pillow mattress of claim 20 including second means for removably fixing said insert within said recess.

35. The heel pillow mattress of claim 34 in which said second means for removably fixing includes a hook and loop fastener.

36. The heel pillow mattress of claim 20 including a corresponding first cover portion having a top and sides enclosing at least the top surface and sides of said first foam layer.

37. The heel pillow mattress of claim 36 including a corresponding second cover portion having a bottom and sides enclosing at least the bottom surface of said third foam layer and the sides of said second and third foam layers.

38. The heel pillow mattress of claim 37 including zipper means for removably attaching said first cover portion to said second cover portion, said zipper means being covered on both its interior and exterior sides by at least one of said sides of said first and second covers.

39. The heel pillow mattress of claim 37 including third means for removably fixing at least one of said foam layers in relationship to its corresponding cover.

40. The heel pillow mattress of claim 39 in which said third means for removably fixing includes a hook and loop fastener.

41. The heel pillow mattress of claim 37 in which said first and second cover portions are water and moisture impervious.

* * * * *